US005444431A

United States Patent [19]

Kenny

[11] Patent Number: 5,444,431

[45] Date of Patent: Aug. 22, 1995

[54] INTRUSION MONITORING DEVICE

[76] Inventor: Paul M. Kenny, Lodge Farm House, 48 Main Street, North Anston, United Kingdom, S31 7BD

[21] Appl. No.: 978,718

[22] Filed: Nov. 19, 1992

[51] Int. Cl.[6] ..... G08B 13/00

[52] U.S. Cl. ..... 340/541; 340/511; 340/567; 340/661

[58] Field of Search ..... 340/565-567, 340/661, 561, 541, 506, 510, 511, 578, 587; 250/342

[56] References Cited

U.S. PATENT DOCUMENTS

| | | | |
|---|---|---|---|
| 3,703,718 | 11/1972 | Berman | 340/567 |
| 3,958,118 | 5/1976 | Schwarz | 250/221 |
| 4,527,158 | 7/1985 | Runnels | 340/961 |
| 4,611,127 | 9/1986 | Ibrahim et al. | 307/116 |
| 4,787,722 | 11/1988 | Claytor | 359/742 |
| 5,084,696 | 1/1992 | Guscott et al. | 340/541 |

FOREIGN PATENT DOCUMENTS 1335410 10/1973 United Kingdom .

*Primary Examiner*—John K. Peng
*Assistant Examiner*—Thomas J. Mullen, Jr.
*Attorney, Agent, or Firm*—Nixon & Vanderhye

[57] ABSTRACT

A voltage level detector circuit comprises an amplifier for amplifying the electrical output signal from a detection device, a pair of comparators for comparing the amplified electrical output signal with a respective threshold signal, wherein each comparator is adapted to change its output state when the amplified electrical output signal exceeds the respective threshold signal, and a pair of threshold processors responsive to a superimposed noise or interference component of the electrical output signal from the detection device, or of an amplified version thereof, and adapted to provide the comparators with respective threshold signals which vary with the superimposed noise or interference component, so as to maintain a relationship between the amplified electrical output signal and the threshold signal which is substantially independent of the superimposed noise or interference component.

33 Claims, 6 Drawing Sheets

WINDOW COMPARATOR WITH INDEPENDENT FLOATING THRESHOLDS

CONVENTIONAL VOLTAGE LEVEL DETECTOR CIRCUIT

CONVENTIONAL METHOD OF VOLTAGE LEVEL DETECTION - NORMAL OPERATION

CONVENTIONAL WINDOW COMPARATOR FOR VOLTAGE LEVEL DETECTION

WINDOW COMPARATOR WITH INDEPENDENT FLOATING THRESHOLDS

WINDOW COMPARATOR WITH INDEPENDENT FLOATING THRESHOLDS and SMALL SIGNAL INPUT-NOISY CONDITIONS

INTRUSION MONITORING DEVICE

BACKGROUND OF THE INVENTION

This invention relates to intrusion monitoring devices, and more particularly to an improved voltage level detection circuit for an intrusion monitoring device having reduced sensitivity to noise and interference.

Commercially available intrusion monitoring devices can be either of the passive or active variety. Passive intrusion monitoring devices can, for example, comprise a sensor which detects infra-red radiation propagated by warm blooded animals. Typically such passive devices comprise a thermal detection device, consisting of one or more thermal detectors adapted to detect infra-red radiation incident thereon, and an optical system for directing incident radiation from a plurality of angular fields of view towards the thermal detection device. Such optical systems may consist of lenses, particularly Fresnel lenses and/or reflecting surfaces. Normally such devices are activated when a source of infra-red radiation passes from one angular sector to the next. Typical prior art intrusion monitoring devices are illustrated in U.S. Pat. Nos. 3,703,718 and 3,958,118, and in UK Patent No. 1335410. A Fresnel lens for use in an intrusion monitoring device is described in U.S. Pat. No. 4,787,722. The complete disclosures of all these patents are included herein by reference.

Active intrusion monitoring devices are also known which comprise a transmitter and a receiver, the transmitter emitting radiation at a defined frequency and the receiver measuring the Doppler shift in any reflected radiation. Such active devices can, for example, operate at microwave frequencies, using a microwave radiation detection device to detect the reflected radiation. Whatever detection device is used, it is necessary in each case to provide an electrical circuit to process the electrical output signal of the detection device and to compare that signal with a pre-set threshold signal.

A problem which has, however, been encountered with conventional intrusion monitoring devices is that if the signal from the detection device has noise or interference superimposed upon it this can result in a false reading leading to an event being incorrectly registered.

It is an object of the present invention to provide an intrusion monitoring device in which the electrical circuit used to process the signal from the detection device is provided with means for suppressing false readings caused by noise and interference superimposed upon the signal.

SUMMARY OF THE INVENTION

The present invention provides a voltage level detector circuit for an intrusion monitoring device in which, under noisy or interference conditions, the threshold signal has superimposed thereon the same noise or interference signal as is present in the amplified electrical output signal.

Accordingly, in one aspect the invention provides a voltage level detector circuit for an intrusion monitoring device wherein said voltage level detector circuit comprises an amplifier means for amplifying an electrical output signal from a detection device, a comparator means for comparing the amplified electrical output signal with at least one threshold signal wherein said comparator means has an output state and is adapted to change said output state when the amplified electrical output signal traverses at least one said threshold signal, and threshold processor means for providing said at least one threshold signal, the threshold processor means being such that in operation under conditions in which noise or interference is present in said electrical output signal, the threshold signal has superimposed thereon the same noise or interference component as is present in the amplified electrical output signal.

In another aspect of the invention the threshold processor means is adapted to provide the comparator means with a threshold signal which varies with said superimposed noise or interference component, so as to maintain a relationship between the amplified electrical output signal and the threshold signal which is substantially independent of said superimposed noise or interference component.

According to a further aspect of the invention there is provided an intrusion monitoring device which comprises a detection device adapted to detect incident radiation thereon and to convert said incident radiation into an electrical output signal, and electrical signal receiving means which comprises amplifier means for amplifying the electrical output signal from the detection device, comparator means for comparing the amplified electrical output signal with a threshold signal, and for emitting an alarm activation signal when the amplified electrical output signal exceeds the threshold signal, and threshold processor means responsive to a superimposed noise or interference component of the electrical output signal from the detection device, or of an amplified version thereof, and adapted to provide the comparator means with a threshold signal which varies with said superimposed noise or interference component, so as to maintain a relationship between the amplified electrical output signal and the threshold signal which is substantially independent of said superimposed noise or interference component.

Preferably the electrical signal receiving means comprises a plurality of threshold processor means providing a plurality of threshold signals and the comparator means compares the amplified electrical output signal with each of the threshold signals, and changes its output state when the amplified electrical output signal traverses at least one of the threshold signals.

The invention may be applied to any suitable intrusion monitoring device, which may be of either the passive or the active variety, or which may combine both functions. Although the invention will be further described with reference to a passive infra-red detector it is to be understood that it is not limited thereto, and may find equal application in active intrusion monitoring devices using microwave radiation, and any suitable other such devices.

DESCRIPTION OF DRAWINGS

An embodiment of a passive infra-red intrusion monitoring device according to the invention will now be described with reference to and as illustrated in the accompanying Drawings in which.

DETAILED DESCRIPTION OF THE INVENTION

Figure 1:
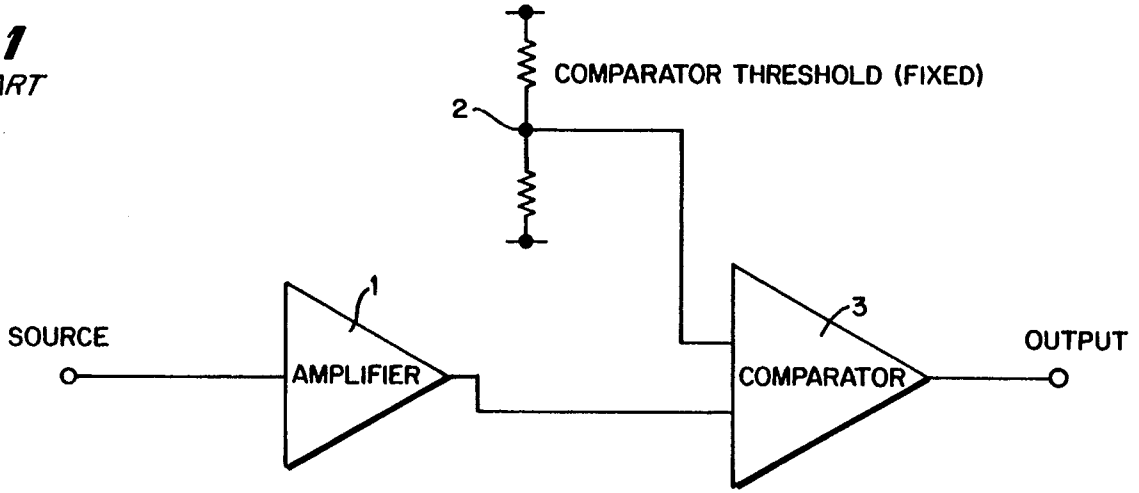
FIG. 1 PRIOR ART
FIG. 1 illustrates a conventional prior art voltage level detector circuit for an intrusion monitoring device.

Referring now to FIG. 1, there is shown a circuit for a conventional voltage level detection device for a passive infra-red intrusion monitoring device. The amplifier 1 gain and band width are dependent upon the type of thermal detection device used, and such devices may, for example, comprise photo-electric, thermistor, thermo-electric, or pyro-electric devices of many different types. In a passive infra-red detector of the present invention the thermal detection device may comprise a plurality of thermal detectors positioned at the common focus of the angular fields of an optical system such that incident radiation focused by any angular field will be incident upon the thermal detectors. Pyro-electric detection devices have been found to be particularly suitable because of their relative simplicity, reliability and low cost. The threshold signal is generated by a resistive potential divider 2 taken from a DC power source or voltage reference.

Figure 2:
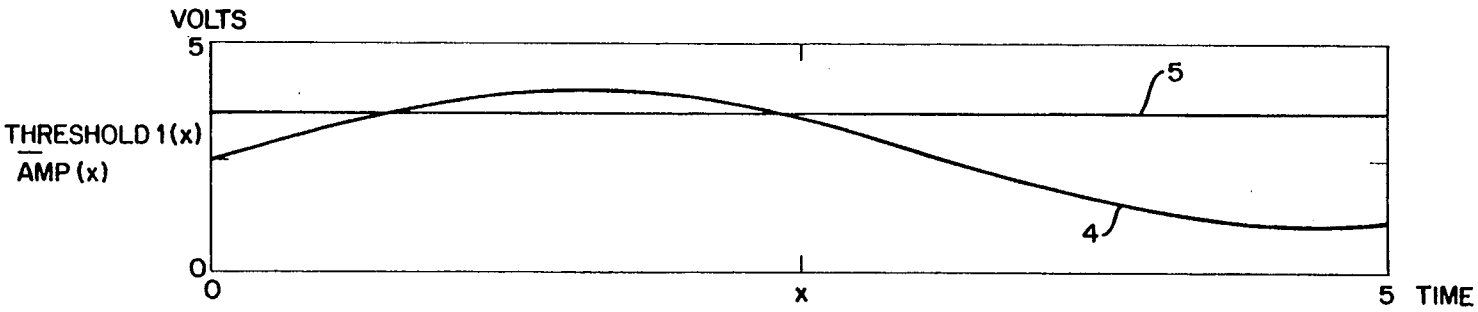
FIG. 2 PRIOR ART
FIG. 2 shows a typical example of the two inputs to the comparator stage of the detector circuit of FIG. 1 in an event condition.

FIG. 2 shows a typical example of the two inputs to the comparator stage 3 of the circuit of FIG. 1. When the amplified output signal 4 traverses the fixed threshold level 5 the comparator 3 output changes state from a logical low to a logical high state, or vice versa, depending upon the configuration of the input signals to the comparator 3.

Figure 3:
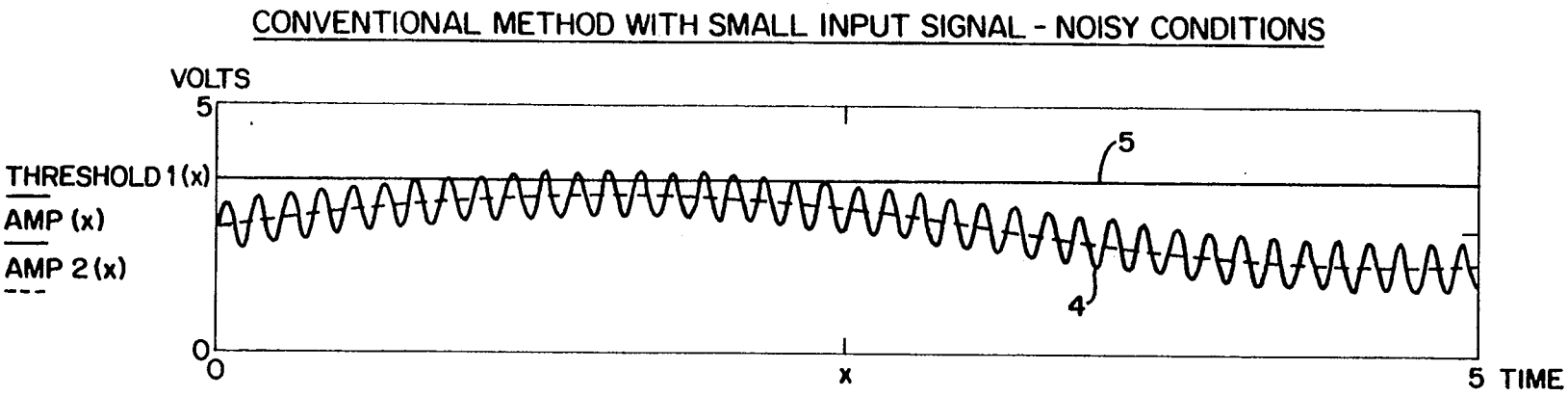
FIG. 3 PRIOR ART
FIG. 3 shows the effect of noise or interference on the input to the comparator stage of the detector circuit of FIG. 1 in a false event condition.
Figure 4:
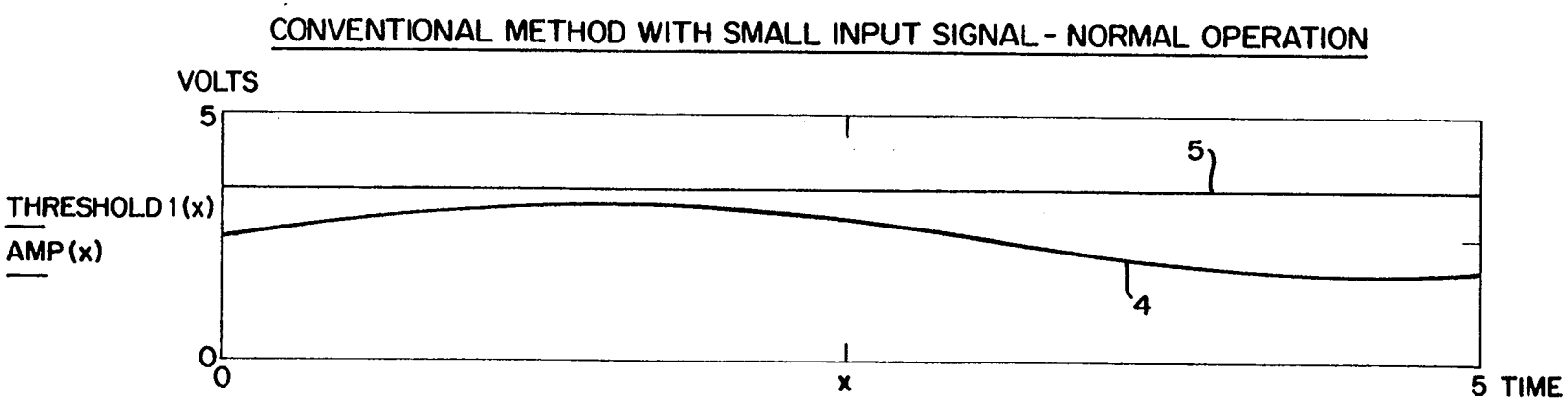
FIG. 4 PRIOR ART
FIG. 4 shows the signals fed to the comparator of FIG. 1 when noise and interference are not present and the source signal is too small for the comparator output to trigger.

If the amplified output signal 4 from the thermal detection device has noise or interference superimposed upon it, then the potential difference between the comparator reference voltage 5 and the amplifier output 4 will be reduced by half the peak to peak magnitude of the noise. This can be detrimental to the performance of the intrusion detection device in certain applications, since false triggering of the comparator 3 output can occur as shown in FIG. 3. FIG. 4 shows the comparator 3 input signals when noise and interference are not present and the output signal 4 from the thermal detection device is too small for the comparator 3 output to trigger.

Figure 5:
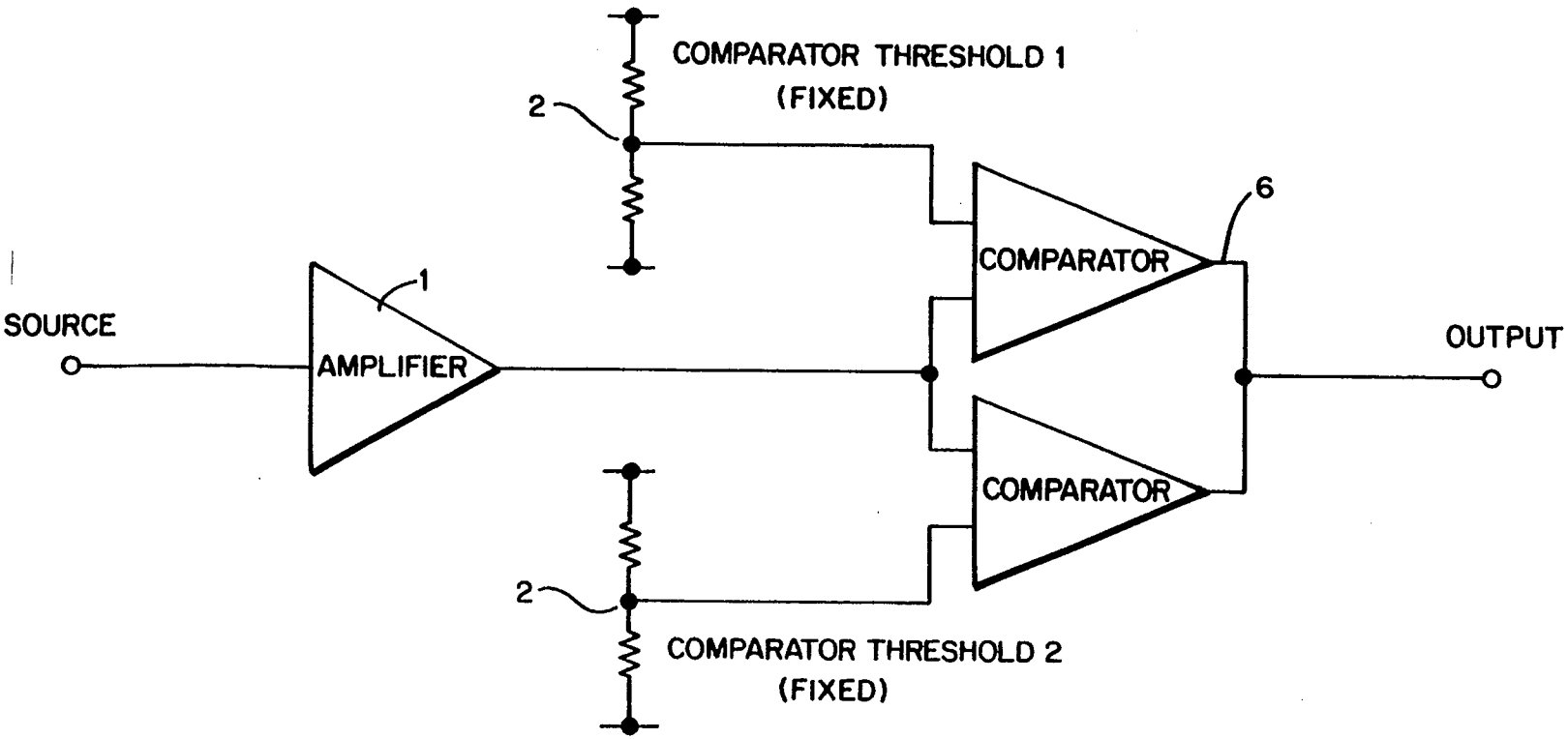
FIG. 5 PRIOR ART
FIG. 5 shows another conventional prior art voltage level detection circuit for an intrusion monitoring device in which the device is provided with two threshold signal generating means forming a signal window.

Illustrated in FIG. 5 is a further prior art voltage level detection circuit which comprises a so-called "window comparator 6" employing two threshold signal generators 2 providing upper and lower signal threshold levels. The output signal from the thermal detection device under normal (non-event) conditions remains within the window between the upper and lower threshold signals.

Figure 6:
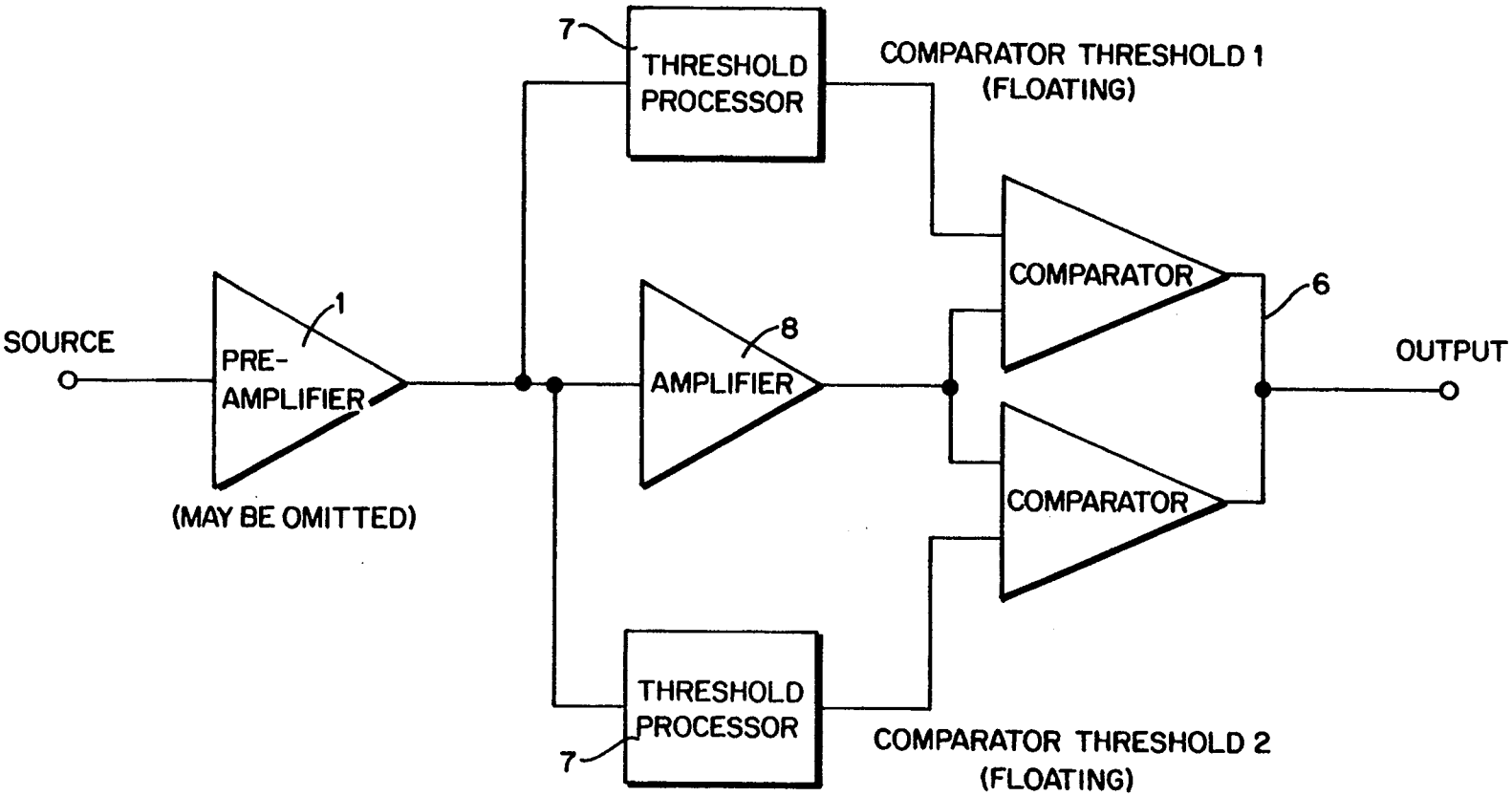
FIG. 6 illustrates the voltage level detector circuit of an intrusion monitoring device according to the invention.

An embodiment of a voltage level detector circuit for an intrusion monitoring device according to the invention is shown in FIG. 6. This employs a window comparator 6 of the type shown in FIG. 5, but in place of the resistive potential dividers 2 providing the fixed DC threshold levels, there are provided a pair of threshold processors 7 or buffer stages which are connected either directly to the output of the thermal detection device, or to the output of a later amplifier stage 1, for example to the coupling point between two band limited amplifier stages. The outputs of the two threshold processors 7 or buffer stages form the threshold signals for the window of the comparator 6. As before, the amplified signal from the thermal detection device is situated, under normal (non-event) conditions, within the window formed by the upper and lower threshold signals, but now all three signals vary in response to any noise or interference component associated with the output signal from the thermal detection device and thus at any time the threshold signals are displaced from their normal position to the same extent that the output signal is displaced from its normal curve by the presence of the noise or interference.

Figure 7:
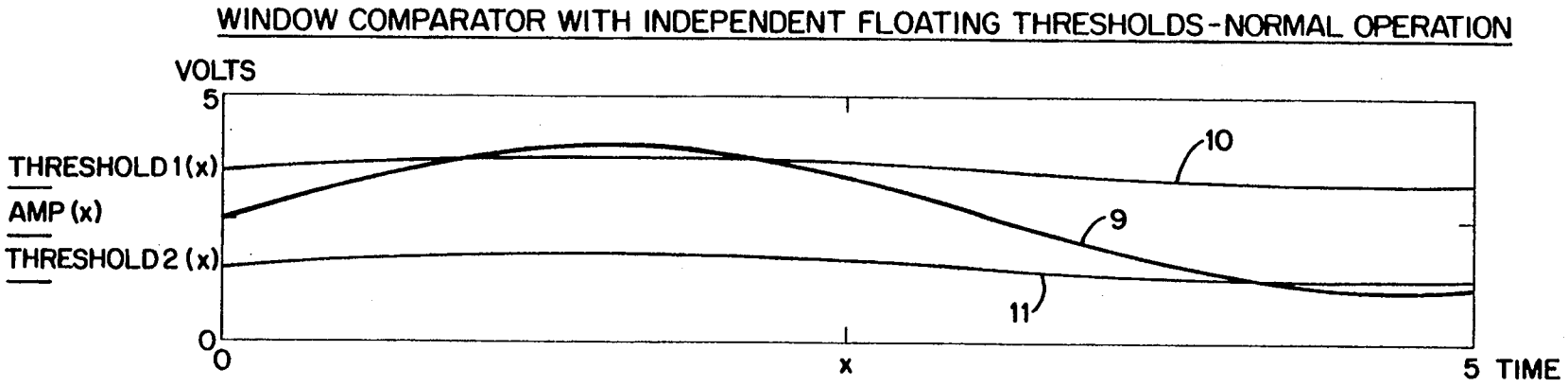
FIG. 7 shows a typical example of the inputs to the comparator stage of the intrusion monitoring device of FIG. 6 in an event condition.
Figure 8:
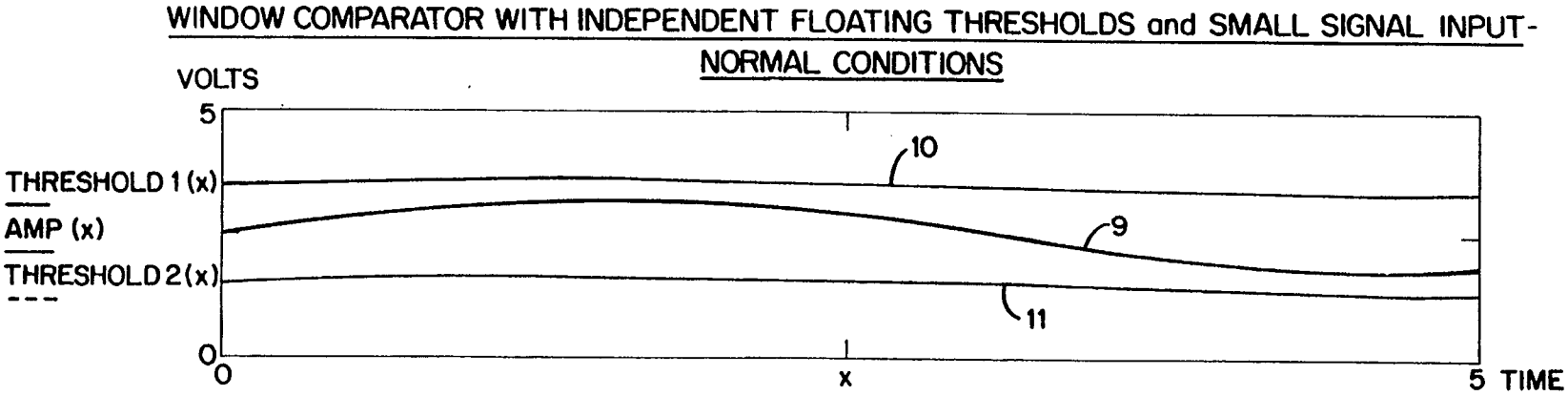
FIG. 8 shows a typical example of the inputs to the comparator stage of the intrusion monitoring device of FIG. 6 operating under normal conditions with the output signal from the detection device being too small for the comparator output to trigger.
Figure 9:
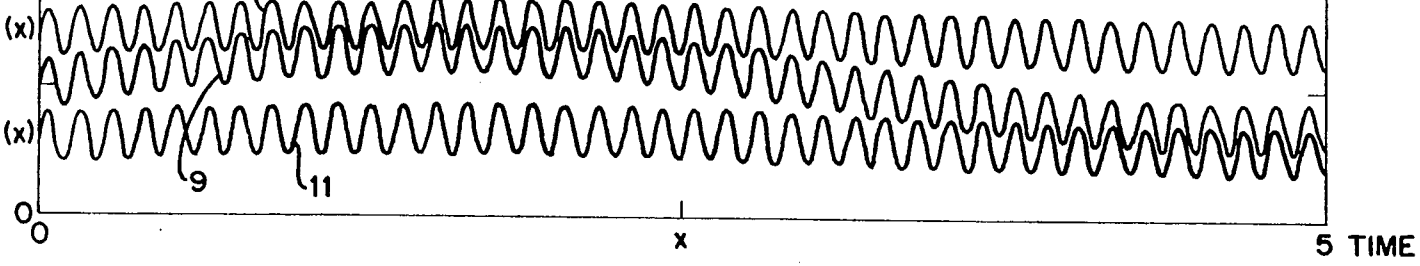
FIG. 9 illustrates the inputs to the comparator stage of the intrusion monitoring device of FIG. 6 with superimposed noise or interference on the electrical output signal when the source signal is too small for the comparator output to trigger.

The operation of the signal detection circuit of an intrusion monitoring device according to the invention is illustrated in FIGS. 7, 8 and 9. Where noise and interference are not present, the comparator inputs in an event condition will appear as shown in FIG. 7, with the signal to voltage threshold ratio being determined by the final amplifier stage 8. In FIG. 7 the output signal 9 is shown traversing both the upper 10 and lower 11 threshold signals and thus this would indicate an event condition sufficient to trigger the comparator output. FIG. 8 shows the inputs to the comparator stage 6 of the circuit of FIG. 6 under normal (non-event) operation, in which the output signal 9 of the thermal detection device lies within the window formed by the upper 10 and lower 11 threshold signals, without triggering the comparator output.

FIG. 9 shows the input to the comparator stage 6 of the circuit of FIG. 6 when noise and interference are present. It can be seen that the noise or interference component superimposed upon the output signal 9 is also superimposed upon the threshold signals 10, 11 in an identical manner thus avoiding false triggering of the comparator output of the type shown in FIG. 3. The comparator output may be connected to further signal processing stages before an alarm condition is generated.

The invention greatly reduces the risk of false triggering at the comparator output, even if the noise is of a continuous nature, whilst still enabling the circuit to function correctly. It can be seen that an event will only trigger the comparator output if the output signal 9 from the thermal detection device traverses either or both of the threshold signals 10, 11 in the same way as if the noise or interference were not present.

Although the invention has been illustrated using electrical hardware components, it will be apparent that embodiments of the invention could also employ software in a computational device such as a computer, microprocessor, or a microcontroller.

The reader's attention is directed to all papers and documents which are filed concurrently with this specification and which are open to public inspection with this specification, and the contents of all such papers and documents are incorporated herein by reference.

All the features disclosed in this specification (including any accompanying claims, abstract and drawings), and/or all of the steps or any method or process so disclosed, may be combined in any combination, except combinations where at least some of such features and/or steps are mutually exclusive.

Each feature disclosed in this specification (including any accompanying claims, abstract and drawings), may be replaced by alternative features serving the same, equivalent or similar purpose, unless expressly stated otherwise. Thus, unless expressly stated otherwise, each feature disclosed is one example only of a generic series of equivalent or similar features.

We claim:

1. A voltage level detector circuit for an intrusion monitoring device wherein said voltage level detector circuit comprises an amplifier means for amplifying an electrical output signal from a detection device connected to the voltage level detector circuit and adapted to detect incident radiation thereon from an intruder and to convert said incident radiation into said electrical output signal, a comparator means for comparing the amplified electrical output signal with at least one threshold signal wherein said comparator means has an output state and is adapted to change said output state when the amplified electrical output signal traverses a selected one of said at least one threshold signals, and threshold processor means for providing said at least one threshold signal, the threshold processor means being such that in operation under conditions in which a noise or interference component is present in said amplified electrical output signal, said at least one threshold signal has superimposed thereon the same noise or interference component as is present in the amplified electrical output signal.

2. A voltage level detector circuit according to claim 1, wherein said threshold processor means comprises a plurality of threshold processors providing a plurality of said threshold signals to the comparator means, and in which the comparator means compares the amplified electrical output signal with each of the threshold signals and changes said output state when the amplified electrical output signal traverses at least one of the threshold signals.

3. A voltage level detector circuit according to claim 1, in which the threshold processor means is connected directly to said detection device.

4. A voltage level detector circuit according to claim 1, in which said amplifier means comprises two band-limited amplifier stages and the threshold processor means is connected to a coupling point between said two band-limited amplifier stages.

5. A voltage level detector circuit according to claim 1, in which said output state of said comparator means changes from a logical low to a logical high state when the amplified electrical output signal traverses a selected one of said at least one threshold signals.

6. A voltage level detector circuit according to claim 1, in which said output state of said comparator means changes from a logical high to a logical low state when the amplified output signal traverses a selected one of said at least one threshold signals.

7. An intrusion monitoring device comprising said detection device and said voltage level detector circuit according to claim 1.

8. An intrusion monitoring device according to claim 7 wherein said detection device comprises a passive detection system.

9. An intrusion monitoring device according to claim 8 wherein said detection device comprises an infra-red detection device.

10. An intrusion monitoring device according to claim 7 wherein said detection device comprises an active detection system.

11. An intrusion monitoring device according to claim 10 wherein said detection device comprises a microwave detection device.

12. A voltage level detector circuit for an intrusion monitoring device wherein said voltage level detector circuit comprises amplifier means for amplifying an electrical output signal from a detection device connected to the voltage level detector circuit and adapted to detect incident radiation thereon from an intruder and to convert said incident radiation into said electrical output signal, comparator means for comparing the amplified electrical output signal with at least one threshold signal wherein said comparator means has an output state and is adapted to change said output state when the amplified electrical output signal traverses a selected one of said at least one threshold signals, and threshold processor means responsive to a superimposed noise or interference component of the electrical output signal from the detection device to provide the comparator means with said at least one threshold signal which varies substantially simultaneously with said superimposed noise or interference component, so as to maintain a relationship between the amplified electrical output signal and said at least one threshold signal which is substantially independent of said superimposed noise or interference component, wherein said threshold processor means comprises a plurality of threshold processors providing a plurality of said threshold signals to the comparator means, and the comparator means compares the amplified electrical output signal with each of the threshold signals and changes said output state when the amplified electrical output signal traverses at least one of the threshold signals.

13. A voltage level detector circuit according to claim 12, in which said output state of said comparator means changes from a logical low to a logical high state when the amplified electrical output signal traverses a selected one of said at least one threshold signals.

14. A voltage level detector circuit according to claim 12, in which said output state of said comparator means changes from a logical high to a logical low state when the amplified output signal traverses a selected one of said at least one threshold signals.

15. A voltage level detector circuit for an intrusion monitoring device wherein said voltage level detector circuit comprises amplifier means for amplifying an electrical output signal from a detection device connected to the voltage level detector circuit and adapted to detect incident radiation thereon from an intruder and to convert said incident radiation into said electrical output signal, comparator means for comparing the amplified electrical output signal with at least one threshold signal wherein said comparator means has an output state and is adapted to change said output state when the amplified electrical output signal traverses a selected one of said at least one threshold signals, and threshold processor means responsive to a superimposed noise or interference component of the electrical output signal from the detection device to provide the comparator means with said at least one threshold signal which varies substantially simultaneously with said superimposed noise or interference component, so as to maintain a relationship between the amplified electrical output signal and said at least one threshold signal which is substantially independent of said superimposed noise or interference component, wherein said amplifier means comprises two band-limited amplifier stages and the threshold processor means is connected to a coupling point between said two band-limited amplifier stages.

16. An intrusion monitoring device which comprises a detection device adapted to detect incident radiation thereon from an intruder and to convert said incident radiation into an electrical output signal, and electrical signal receiving means which comprises amplifier means for amplifying the electrical output signal from the detection device, comparator means for comparing the amplified electrical output signal with a threshold signal, and for emitting an alarm activation signal when the amplified electrical output signal exceeds the threshold signal, and threshold processor means adapted to be responsive to a superimposed noise or interference component of the electrical output signal from the detection device, or of the amplified electrical output signal, and adapted to provide the comparator means with said threshold signal which varies substantially instantaneously with said superimposed noise or interference component, so as to maintain a relationship between the amplified electrical output signal and the threshold signal which is substantially independent of said superimposed noise or interference component, wherein the electrical signal receiving means comprises a plurality of said threshold processor means providing a plurality of said threshold signals and the comparator means compares the amplified electrical output signal with each of the threshold signals, and an output state of said comparator means changes when the amplified electrical output signal traverses at least one of the threshold signals.

17. A voltage level detector circuit for an intrusion monitoring device wherein said voltage level detector circuit comprises amplifier means for amplifying an electrical output signal from a detection device connected to the voltage level detector circuit and adapted to detect incident radiation thereon from an intruder and to convert said incident radiation into said electrical output signal, comparator means for comparing the amplified electrical output signal with at least one threshold signal wherein said comparator means has an output state and is adapted to change said output state when the amplified electrical output signal traverses a selected one of said at least one threshold signals, and threshold processor means responsive to a superimposed noise or interference component of the electrical output signal from the detection device and comprising a plurality of threshold processors to provide the comparator means with a plurality of said threshold signals which vary with said superimposed noise or interference component, so as to maintain a relationship between the amplified electrical output signal and said at least one threshold signal which is substantially independent of said superimposed noise or interference component and in which the comparator means compares the amplified electrical output signal with each of the threshold signals and changes said output state when the amplified electrical output signal traverses at least one of the threshold signals.

18. A voltage level detector circuit for an intrusion monitoring device wherein said voltage level detector circuit comprises amplifier means comprising two band-limited amplifier stages for amplifying an electrical output signal from a detection device connected to the voltage level detector circuit and adapted to detect incident radiation thereon from an intruder and to convert said incident radiation into said electrical output signal, comparator means for comparing the amplified electrical output signal with at least one threshold signal wherein said comparator means has an output state and is adapted to change said output state when the amplified electrical output signal traverses a selected one of said at least one threshold signals, and threshold processor means connected to a coupling point between said two band-limited amplifier stages and responsive to a superimposed noise or interference component of the electrical output signal from the detection device to provide the comparator means with said at least one threshold signal which varies with said superimposed noise or interference component, so as to maintain a relationship between the amplified electrical output signal and said at least one threshold signal which is substantially independent of said superimposed noise or interference component.

19. An intrusion monitoring device which comprises a detection device adapted to detect incident radiation thereon from an intruder and convert said incident radiation into an electrical output signal, and electrical signal receiving means which comprises amplifier means for amplifying the electrical output signal from the detection device, comparator means for comparing the amplified electrical output signal with a threshold signal, and for emitting an alarm activation signal when the amplified electrical output signal exceeds the threshold signal, and a plurality of threshold processor means adapted to be responsive to a superimposed noise or interference component of the electrical output signal from the detection device or of the amplified electrical output signal and providing the comparator means with a plurality of said threshold signals which vary with said superimposed noise or interference component, so as to maintain a relationship between the amplified electrical output signal and the threshold signal which is substantially independent of said superimposed noise or interference component, wherein the comparator means compares the amplified electrical output signal with each of the threshold signals, and an output state of said comparator means changes when the amplified electrical output signal traverses at least one of the threshold signals.

20. A voltage level detector circuit for an intrusion monitoring device wherein said voltage level detector circuit comprises comparator means for comparing an electrical output signal, from a detection device connected to the voltage level detector circuit and adapted to detect incident radiation thereon from an intruder and to convert said incident radiation into said electrical signal, with at least one threshold signal wherein said comparator means has an output state and is adapted to change said output state when the electrical output signal traverses a selected one of said at least one threshold signals, and threshold processor means for providing said at least one threshold signal, the threshold processor means being such that in operation under conditions in which a noise or interference component is present in said electrical output signal, said at least one threshold signal has superimposed thereon the same noise or interference component as is present in said electrical output signal.

21. A voltage level detector circuit according to claim 20, wherein said threshold processor means comprises a plurality of threshold processors providing a plurality of said threshold signals to the comparator means, and in which the comparator means compares the electrical output signal with each of the threshold signals and changes said output state when the electrical output signal traverses at least one of the threshold signals.

22. A voltage level detector circuit according to claim 20, in which the threshold processor means is connected directly to said detection device.

23. A voltage level detector circuit according to claim 20, in which said output state of said comparator means changes from a logical low to a logical high state when the electrical output signal traverses a selected one of said at least one threshold signals.

24. A voltage level detector circuit according to claim 20, in which said output state of said comparator means changes from a logical high to a logical low state when the electrical output signal traverses a selected one of said at least one threshold signals.

25. A voltage level detector circuit for an intrusion monitoring device wherein said voltage level detector circuit comprises comparator means for comparing an electrical output signal, from a detection device connected to the voltage level detector circuit and adapted to detect incident radiation thereon from an intruder and to convert said incident radiation into said electrical output signal, with at least one threshold signal wherein said comparator means has an output state and is adapted to change said output state when the electrical output signal traverses a selected one of said at least one threshold signals, and threshold processor means responsive to a superimposed noise or interference component of the electrical output signal from the detection device to provide the comparator means with said at least one threshold signal which varies substantially instantaneously with said superimposed noise or interference component, so as to maintain a relationship between the electrical output signal and said at least one threshold signal which is substantially independent of said superimposed noise or interference component, wherein said threshold processor means comprises a plurality of threshold processors providing a plurality of said threshold signals to the comparator means, and in which the comparator means compares the electrical output signal with each of the threshold signals and changes said output state when the electrical output signal traverses at least one of the threshold signals.

26. A voltage level detector circuit according to claim 25, in which the threshold processor means is connected directly to said detection device.

27. A voltage level detector circuit according to claim 25, in which said output state of said comparator means changes from a logical low to a logical high state when the electrical output signal traverses a selected one of at least one threshold signals.

28. A voltage level detector circuit according to claim 25, in which said output state of said comparator means changes from a logical high to a logical low state when the output signal traverses a selected one of said at least one threshold signals.

29. An intrusion monitoring device comprising said detection device and said voltage level detector circuit according to claim 25.

30. An intrusion monitoring device according to claim 29 wherein said detection device comprises a passive detection system.

31. An intrusion monitoring device according to claim 29 wherein said detection device comprises an infra-red detection device.

32. An intrusion monitoring device according to claim 29 wherein said detection device comprises an active detection system.

33. An intrusion monitoring device according to claim 32 wherein said detection device comprises a microwave detection device.

* * * * *